United States Patent [19]

Umezu et al.

[11] 4,435,927

[45] Mar. 13, 1984

[54] MODULAR BUILDING STRUCTURE AND MODULE FOR IT

[75] Inventors: Hiroaki Umezu; Akira Kishi, both of Tokyo; Hiroshi Yamagami, Hachioji, all of Japan

[73] Assignee: Misawa Homes K.K., Tokyo, Japan

[21] Appl. No.: 275,152

[22] Filed: Jun. 19, 1981

[51] Int. Cl.[3] ..... E04B 1/343

[52] U.S. Cl. ..... 52/79.13; 52/235

[58] Field of Search ..... 52/79.1, 79.2, 79.3, 52/79.7, 79.8, 79.9, 79.13, 235

[56] References Cited

U.S. PATENT DOCUMENTS

| | | | |
|---|---|---|---|
| 3,568,380 | 3/1971 | Stucky | 52/79.1 |
| 3,717,964 | 2/1973 | Brown | 52/79.1 |
| 3,824,750 | 7/1974 | Antoniou | 52/79.13 |
| 4,023,315 | 5/1977 | Stucky | 52/79.13 |

FOREIGN PATENT DOCUMENTS

| | | | |
|---|---|---|---|
| 2419627 | 11/1974 | Fed. Rep. of Germany | 52/79.13 |
| 2624863 | 8/1977 | Fed. Rep. of Germany | 52/79.1 |

*Primary Examiner*—John E. Murtagh

*Attorney, Agent, or Firm*—Kane, Dalsimer, Kane, Sullivan and Kurucz

[57] ABSTRACT

A module for a modular building structure comprises a frame including a horizontal base member of a rectangular shape and four vertical corner posts of the same length secured at their lower ends to the four corners of the base member. A first wall member is attached to two adjacent ones of the four corner posts. A second wall member is attached to one of the two adjacent corner posts and the corner post disposed in diagonal relation to the other of the two adjacent corner posts.

1 Claim, 2 Drawing Figures

MODULAR BUILDING STRUCTURE AND MODULE FOR IT

BACKGROUND OF THE INVENTION

1. Field of the Invention

This invention relates to a modular building structure composed of a plurality of modules.

2. Prior Art

A conventional modular building structure is constructed of a plurality of prefabricated box-like modules joined in side by side and stacked relation. The box-like module usually has a floor wall, a ceiling wall and four side walls. With this structure, the adjacent ceiling wall and floor wall of each vertically adjacent modules constitute a double wall construction. Similarly, the adjacent side walls of each horizontally adjacent modules constitute a double wall construction. This double wall construction is undesirable because of the use of the added wall material. Each of the box-like modules includes a frame having four corner posts to which the four side walls are fixedly secured. Each vertically adjacent modules are designed to be joined together by connecting their corresponding corner posts in end to end relation. Because of inaccuracy inherent in the manufacture of the prefabricated modules, the corresponding corner posts of the vertically adjacent modules are not always disposed accurately in alignment with one another when assemblying the modules to provide the modular building structure. In this case, it is necessary to detach the wall members from the frame so that the corresponding corner posts of the vertically adjacent modules are brought accurately into alignment with one another to connect them in end to end relation. This requires much time and labor.

SUMMARY OF THE INVENTION

It is therefore an object of this invention to provide a module for modular building structures which is designed to avoid a double wall construction as mentioned above.

Another object is to provide a modular building structure in which the corresponding corner posts of vertically adjacent modules can be easily brought into alignment with one another when assemblying the modular building structure.

According to the invention, there is provided a module for a modular building structure which comprises a frame including a horizontal base member of a rectangular shape and four vertical corner posts of the same length secured at their lower ends to the four corners of said base member; a first wall member attached to two adjacent ones of said four corner posts, said first wall member being vertically coextensive with said corner posts; and a second wall member attached to one of said two adjacent corner posts and the corner post disposed in diagonal relation to the other of said two adjacent corner posts, said second wall member being vertically coextensive with said corner posts.

DETAILED DESCRIPTION OF THE PREFERRED EMBODIMENT

Figure 1:
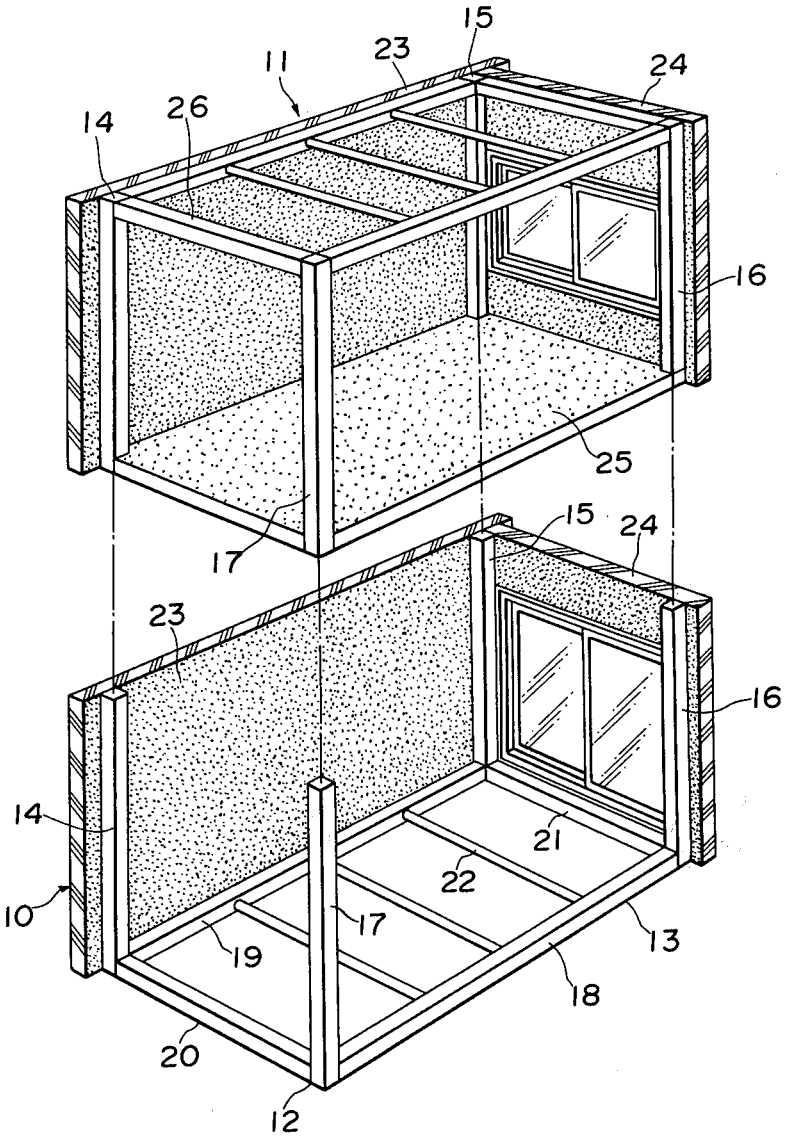
FIG. 1 is a perspective view of a pair of modules provided in accordance with the invention.

FIG. 1 shows a lower module 10 and an upper module 11 which are joined together to form a modular building structure. The lower module 10 comprises a frame 12 which includes a horizontal base 13 of a rectangular shape and four vertical corner posts 14, 15, 16, 17 of the same length secured at their lower ends to the four corners of the rectangular base 13, respectively. The base 13 comprises a pair of longitudinal bars 18, 19, a pair of lateral bars 20, 21 interconnecting the longitudinal bars 18, 19 at their opposite ends, and a plurality of cross bars 22 secured to and extending between the longitudinal bars 18, 19. Each of the corner posts 14, 15, 16, 17 is made of steel and is of a tubular construction having a square cross-section.

A first wall member 23 is attached to the corner posts 14, 15 and is vertically coextensive therewith. A second wall member 24 is attached to the corner posts 15, 16 and is coextensive therewith.

The upper module 11 differs from the lower module 10 in that it has a floor member 25 secured to the lower ends of the four corner bars 14, 15, 16, 17 and in that it has a rectangular upper portion 26 secured to the upper ends of the four corner posts. The three corner posts 14, 16, 17 of the lower module 10 are secured to the base 18 in such a manner that they are slightly swingingly movable about their lower ends. The two posts 14, 16 are secured to the first and second wall members 23, 24 at one portions thereof so that they are slightly swingingly movable. The corner post 17 to which no wall member is attached is swingingly movable to a degree greater than the two corner posts 14, 16.

Figure 2:
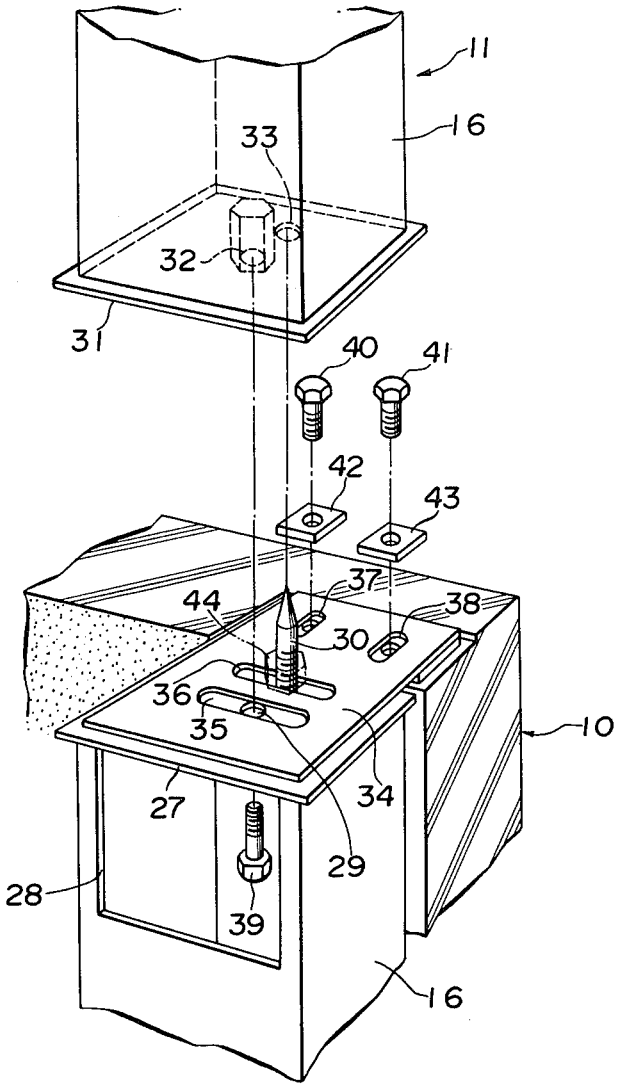
FIG. 2 is a perspective view of a portion of the two modules.

The upper and lower modules 10, 11 are assembled together by connecting the corresponding corner pots in end to end relation. As shown in FIG. 2, each of the corner posts of the lower module 10 has an upper end member 27 fixedly secured to its upper end. Each of the corner posts of the lower module has a square opening 28 at one side thereof adjacent to the upper end member 27. A bolt receiving hole 29 is formed through the upper end member 27 generally at the center thereof. A guide pin 30 is fixedly secured to and extends upwardly from the upper end member 27, the guide pin 30 is disposed adjacent to the bolt receiving hole 29 and has a tappered upper end. The guide pin 30 extends in parallel relation to the longitudinal axis of each corner post.

Each of the corner posts 14, 15, 16, 17 of the upper module 11 has a lower end member 31, and a bolt receiving portion 32 is formed integrally on the inner side of the lower end member 31, the bolt receiving portion being in the form of an internally threaded socket. The bolt receiving portion 32 is disposed generally at the center of the lower end member 31. A guide pin-receiving hole 33 is formed through the lower end member 31 adjacent to the bolt-receiving portion 32. The distance between the axes of the bolt-receiving hole 29 and the guide pin 30 is equal to the distance between the axes of the bolt-receiving portion 32 and the guide pin receiving hole 33.

A pair of connecting plates 34 of a rectangular shape are attached to the upper end member 27 of the two corner posts 14, 16 to which the first and second wall members 23, 24 are attached, respectively. Each of the connecting plate 34 has a pair of parallel spaced slots 35, 36 and a pair of parallel spaced slots 37, 38 at its one end portion which extend perpendicular to the slots 35, 36.

The connecting plate 34 is mated with the upper end member 27 with the guide pin 30 extending through the slot 36, the connecting plate 34 being laid over the upper surface of the wall member 23, 24 at its one end portion. In this condition, the pair of slots 35, 36 are disposed substantially in parallel relation to the plane of the associated wall member 23, 24. The guide pin 30 extends through the slot 36 into the guide pin receiving hole 33. A bolt 39 extends through the bolt receiving hole 29 and the slot 35 and is threaded into the bolt receiving portion 32. The connecting plate 34 is mated with the lower end member 31. A pair of bolts 40, 41 extend through the slots 37, 38 and are threaded into the upper portion of the wall member 23, 24 to fix the connecting plate 34 relative to the wall member.

For connecting the lower and upper modules 10, 11 together, the guide pin 30 is first inserted into the guide pin receiving hole 33 so that the bolt receiving hole 29 is brought into alignment with the bolt receiving portion 32 since the three corner posts 14, 16, 17 of the lower module 10 are sightly swingingly movable as described above. Thus, even if the corresponding corner posts of the upper and lower modules 11, 10 are slightly out of alignment with one another when the upper module 11 is placed on the lower module 10, the alignment operation can be easily carried out without the need for the detachment of the wall members 23, 24 from the corner posts. Thereafter, the bolt 39 is passed through the bolt receiving hole 29 and the slot 35 and is threaded into the bolt receiving portion 32 to fasten the corresponding corner posts 14, 15, 16, 17 of the upper and lower modules 11, 10 together. This fastening operation is readily carried out by virtue of the provision of the opening 28. Then, the bolts 40, 41 are passed through the washers 42, 43 and the slots 37, 38 and are threaded into the upper portion of the wall member 23, 24 to fully fix the wall member relative to the corner post 14, 16.

In the illustrated embodiment, the two sides of the upper module 11 do not have wall members. But, it will be readily appreciated that the upper module having such side wall members can be connected to the lower module 10 in the manner described above. A nut 44 shown in broken lines in FIG. 2 is threaded on the guide pin 30 to retain the connecting plate 34 on the upper end member of the corner post. This nut 44 is removed from the guide pin 30 when connecting the upper and lower modules 11, 10 together at a construction site.

The modules 10, 11, have the two side wall members 23, 24 and the base 13 or the floor member 25. With this construction, when the upper and lower modules 11, 10 are assembled in a stacked relation as in the illustrated embodiment, the floor member 25 of the upper module 11 also serves as a ceiling for the lower module 10, so that a double wall construction is advantageously avoided. Also, when the modules are assembled in side by side relation, the side wall member of the module also serves as a side wall of the adjacent modules, so that a double wall construction is avoided.

For illustration purposes, the modular building structure comprising the upper and lower modules 11, 10 is shown in the illustrated embodiment. However, it will be readily appreciated that a desired number of modules may be assembled in stacked and side by side relation to provide a required modular building structure. In this case, the outermost module or modules and the uppermost module or modules have additional wall members. When the modules are assembled in side by side relation, the horizontally adjacent modules are joined together by connecting the corresponding corner posts by suitable fastening members or by welding or the like.

What is claimed is:

1. A modular building structure which comprises an upper and lower structure, each having:

(a) a frame including a horizontal base member of a rectangular shape and four vertical corner posts of the same length secured at their lower ends to the four corners of said base member and having a tubular construction;

(b) a first wall member attached to two adjacent ones of said four corner posts, said first wall member being vertically coextensive with said corner posts; and (c) a second wall member attached to one of said two adjacent corner posts and the corner post disposed in diagonal relation to the other of said two adjacent corner posts, said second wall member being vertically coextensive with said corner posts; each of the corner posts of said lower module having an upper end member fixedly secured to its upper end, a bolt receiving hole being formed through said upper end member, a guide pin being fixedly secured to said upper end member and extending upwardly therefrom in parallel relation to the longitudinal axis of said corner post, each of the corner posts of said upper module having a lower end member fixedly secured to its lower end, a bolt receiving portion being formed on said lower end member, a guide pin receiving hole being formed through said lower end member, the corresponding corner posts of said upper and lower modules being connected in end to end relation, said guide pin of each corner post of said lower module passing through said guide pin receiving hole of the corresponding corner post of said upper module, and a bolt passing through said bolt receiving hold of each corner post of said lower module and being threaded into said bolt receiving portion of the corresponding corner post of said upper module; the corner posts of the lower module, except for the corner post adjacent to said first and second wall members, being attached slightly swingingly movable about their lower end; said upper module including a pair of connecting plates attached to the upper end members of the two corner posts which are disposed in diagonal relation and to which said first and second wall members are attached, said connecting plates extending outwardly from said corner posts to be laid over the upper surfaces of said first and second wall members, respectively, each of said connecting plates having a pair of first slots extending parallel to the plane of a respective one of said first and second wall members, and having a pair of second slots extending perpendicular to the plane of the respective wall member, said guide pin and said bolt passing through said pair of first slots, respectively, and a pair of bolts passing through said pair of second slots into the upper portion of a respective one of said first and second wall members.

* * * * *